US008504440B1

(12) United States Patent
Kolawa et al.

(10) Patent No.: US 8,504,440 B1
(45) Date of Patent: Aug. 6, 2013

(54) SYSTEM AND METHOD FOR AUTOMATED RECIPE SELECTION AND SHOPPING LIST CREATION

(75) Inventors: Adam Kolawa, Bradbury, CA (US); Marc Elroy Campbell, Monrovia, CA (US)

(73) Assignee: Dietfood Corp., Monrovia, CA (US)

( * ) Notice: Subject to any disclaimer, the term of this patent is extended or adjusted under 35 U.S.C. 154(b) by 791 days.

(21) Appl. No.: 11/529,895

(22) Filed: Sep. 29, 2006

Related U.S. Application Data

(60) Division of application No. 09/885,308, filed on Jun. 20, 2001, now abandoned, which is a continuation-in-part of application No. 09/792,343, filed on Feb. 23, 2001, now Pat. No. 8,429,026, which is a continuation-in-part of application No. 09/556,051, filed on Apr. 21, 2000, now abandoned, which is a continuation-in-part of application No. 09/340,518, filed on Jun. 28, 1999, now Pat. No. 6,370,513.

(51) Int. Cl.
*G06Q 30/00* (2012.01)

(52) U.S. Cl.
USPC ..... 705/26.7; 705/26.8

(58) Field of Classification Search
USPC ..... 705/26.7, 26.8
See application file for complete search history.

(56) References Cited

U.S. PATENT DOCUMENTS

| | | | | |
|---|---|---|---|---|
| 4,807,169 A | | 2/1989 | Overbeck | |
| 4,996,642 A | | 2/1991 | Hey | |
| 5,041,972 A | * | 8/1991 | Frost | 705/10 |
| 5,047,614 A | | 9/1991 | Bianco | |
| 5,124,911 A | * | 6/1992 | Sack | 705/10 |
| 5,233,520 A | | 8/1993 | Kretsch et al. | |
| 5,412,564 A | | 5/1995 | Ecer | |
| 5,583,763 A | | 12/1996 | Atcheson et al. | |
| 5,664,110 A | | 9/1997 | Green et al. | |
| 5,704,017 A | | 12/1997 | Heckerman et al. | |
| 5,724,567 A | | 3/1998 | Rose et al. | |
| 5,749,081 A | | 5/1998 | Whiteis | |
| 5,790,426 A | | 8/1998 | Robinson | |

(Continued)

FOREIGN PATENT DOCUMENTS

| | | |
|---|---|---|
| EP | 0 751 471 A1 | 1/1997 |
| JP | 08 063 455 | 3/1996 |
| JP | 08 064 355 A | 3/1996 |

OTHER PUBLICATIONS

Co-pending U.S. Appl. No. 10/278,636, filed Oct. 23, 2002, entitled Automated Music Profiling and Recommendation.

(Continued)

*Primary Examiner* — Yehdega Retta

(74) *Attorney, Agent, or Firm* — Christie, Parker & Hale, LLP

(57) ABSTRACT

An electronic shopping system recommending recipes and creating shopping lists. A user selects items for purchase and proceeds to a point-of-sale terminal for checkout. The point-of-sale terminal transmits information of the purchased items to a network computer which uses the information to update a taste profile for the user. Based on the taste profile, the network computer recommends recipes that may be prepared using the items just purchased. The network computer also creates the user's meal plan for the week based on the user's taste profile, and provides the meal plan along with a shopping list.

20 Claims, 5 Drawing Sheets

U.S. PATENT DOCUMENTS

| | | | | |
|---|---|---|---|---|
| 5,832,446 | A | 11/1998 | Neuhaus | |
| 5,859,414 | A | 1/1999 | Grimes et al. | |
| 5,872,850 | A | 2/1999 | Klein et al. | |
| 5,884,281 | A | 3/1999 | Smith et al. | |
| 5,884,282 | A | 3/1999 | Robinson | |
| 5,899,502 | A | 5/1999 | Del Giorno | |
| 5,905,973 | A | 5/1999 | Yonezawa et al. | |
| 5,918,223 | A | 6/1999 | Blum et al. | |
| 5,954,640 | A | 9/1999 | Szabo | |
| 5,960,440 | A | 9/1999 | Brenner et al. | |
| 5,963,948 | A | 10/1999 | Shilcrat | |
| 5,969,283 | A | 10/1999 | Looney et al. | |
| 5,978,766 | A | 11/1999 | Luciw | |
| 5,979,757 | A | 11/1999 | Tracy et al. | |
| 5,983,200 | A | 11/1999 | Slotznick | |
| 5,999,975 | A | 12/1999 | Kittaka et al. | |
| 6,012,051 | A | 1/2000 | Sammon et al. | |
| 6,018,738 | A | 1/2000 | Breese et al. | |
| 6,020,883 | A | 2/2000 | Herz et al. | |
| 6,040,531 | A * | 3/2000 | Miller-Kovach et al. | 177/25.16 |
| 6,046,021 | A | 4/2000 | Bochner | |
| 6,112,186 | A | 8/2000 | Bergh et al. | |
| 6,232,539 | B1 | 5/2001 | Looney et al. | |
| 6,236,974 | B1 | 5/2001 | Kolawa et al. | |
| 6,236,978 | B1 | 5/2001 | Tuzhilin | |
| 6,236,990 | B1 | 5/2001 | Geller et al. | |
| 6,266,649 | B1 * | 7/2001 | Linden et al. | 705/26 |
| 6,358,546 | B1 | 3/2002 | Bebiak et al. | |
| 6,370,513 | B1 | 4/2002 | Kolawa et al. | |
| 6,434,530 | B1 | 8/2002 | Sloane et al. | |
| 6,458,080 | B1 * | 10/2002 | Brown et al. | 600/300 |
| 6,587,835 | B1 * | 7/2003 | Treyz et al. | 705/14 |
| 6,618,062 | B1 * | 9/2003 | Brown et al. | 715/822 |
| 6,953,886 | B1 | 10/2005 | Looney et al. | |
| 7,205,471 | B2 | 4/2007 | Looney et al. | |
| 7,392,193 | B2 * | 6/2008 | Mault | 704/275 |

OTHER PUBLICATIONS

Co-pending U.S. Appl. No. 10/668,926, filed Sep. 23, 2003, entitled Audio Fingerprinting System and Method.

Food Chemical News, Database Management is Key to Database Quality; Jul. 22, 1995, v. 38 n. 22.

Internet Papers: http://www.iVillage.com; IVillage.com The Women's Network; (downloaded May 22, 2001); 6 sheets.

Internet Papers: http://www.meals.com; Meals.com Meal Planning Made Easy; (downloaded May 21, 2001); www.my-meals.com; 9 pp.

Internet Papers: http://www.foodfit.com; FoodFit; (downloaded May 22, 2001); 7 pp.

Internet Papers: https://www.mealsforyou.com; Meals for You; (downloaded May 21, 2001); 4 pp.

Internet Papers: http://www.ourhouse.com; Tavolo, Inc. (downloaded May 21, 2001); 7 pp.

Internet Papers: http://www.recipezaar.com; Recipezaar; (downloaded May 22, 2001); 7 pp.

Internet Papers: http://www.ucook.com; The Ultimate Cookbook; (downloaded May 22, 2001); 6 pp.

Unklesbay et al.; An automated system for planning menus for the elderly in the title VII nutrition programs; Food Technology, 32 (8) 80-83.

http://web.archive.org/web/20000519225907/http://www.mealsforyou.com/; Meals for you.

http://web.archive.org/web/20000120344600/http://www.mealsforyou.com/ Meals for you web site.

Internet Archive Wayback Machine; http://web.archive.org/web/*/http://mealsforou.com.

Bill Communications Inc.; A Steady Stream of New Applications . . . Institutional Distribution; v. 19; Nov. 1983.

A steady stream of new applications: order processing, operations, customer services, electronic communications; The Gale Group; Jun. 9, 1996; 8 pages.

Co-pending U.S. Appl. No. 09/885,307, filed Jun. 20, 2001, entitled Acoustical Preference Tuner.

Co-pending U.S. Appl. No. 09/792,343, filed Feb. 23, 2001, entitled System and Method for Creating and Submitting Electronic Shopping Lists.

* cited by examiner

SYSTEM AND METHOD FOR AUTOMATED RECIPE SELECTION AND SHOPPING LIST CREATION

CROSS-REFERENCE TO RELATED APPLICATIONS

This application is a divisional of U.S. Ser. No. 09/885,308, filed Jun. 20, 2001, which is a continuation-in-part of U.S. Ser. No. 09/792,343, filed Feb. 23, 2001, now U.S. Pat. No. 8,429,026, which is a continuation-in-part of application Ser. No. 09/556,051, filed on Apr. 21, 2000, which is a continuation-in-part of application Ser. No. 09/340,518, filed on Jun. 28, 1999, now U.S. Pat. No. 6,370,513, the contents of which are incorporated herein by reference.

FIELD OF THE INVENTION

The present invention relates generally to electronic shopping systems, more particularly, to electronic terminals recommending recipes and providing shopping lists for a customer.

BACKGROUND OF THE INVENTION

Individuals are often faced with the dilemma of what to eat or cook for a particular meal. In today's society where families consist of either two working spouses or a single working parent, such a decision may cause extra dilemma and stress on the parent who comes home from a long day at work and tackles the decision of what to make for dinner. Thus, if the parent gets home from work around dinner time, he or she may opt for something simple and quick. As a consequence, the family's menu is unimaginative, and the family typically ends up eating the same food over and over again.

Even if the parent wants to prepare a new dish, he or she may be faced with the dilemma of finding a recipe that will cater to the family's tastes. Furthermore, even if a recipe is selected, the ingredients needed to prepare the meal may not be available at home. Given the busy schedule of today's parents, it is not practical for the parent to make trips to the supermarket each time an ingredient is needed.

Generally, many people schedule shopping trips for once a week. In order to make such shopping trips as productive as possible, the parent often investigates prior to the trip what items need to be replenished and what new items need to be purchased based on the recipes to be prepared that week. Many parents spend considerable amounts of time making shopping lists based on these investigations.

Accordingly, there is a need for a system and method for recommending recipes to users that are catered to the tastes of such users and/or the tastes of their family. Such a system and method should further automatically provide a shopping list of ingredients necessary for creating one or more of the recommended recipes. The shopping list should be made available to the user during or prior to his or her regular shopping trip.

SUMMARY OF THE INVENTION

The present system is directed to an electronic shopping system for use in a retail facility. The electronic shopping system includes a first terminal, a second terminal, and a network computer coupled to the first terminal and the second terminal. The first terminal transmits to the network computer information on items selected for purchase by a user. The network computer updates a taste profile for the user based on the selected items and selects a set of recipes based on the updated taste profile. The network computer further identifies recipes in the set including at least one of the selected items as an ingredient, and provides at least one of the identified recipes to the user via the first terminal or the second terminal.

In one embodiment of the invention, the network computer further creates a meal plan based on the updated taste profile and transmits the meal plan to the user at a predetermined time.

In another embodiment of the invention, the network computer also creates a shopping list based on the meal plan and transmits the shopping list at the predetermined time.

In a further embodiment of the invention, a system for recommending recipes and shopping lists includes a customer database, a recipe database, a product database, and a network computer coupled to the customer database, recipe database, and product database. The customer database includes a plurality of customer records, each customer record including purchase history information and a taste profile for a particular user. The recipe database includes a plurality of recipe records, each recipe record including a list of ingredients and a recipe profile for a particular recipe. The product database includes a product information table, the product information table including a list of merchandise items and a product profile for each merchandise item associated with food. The network computer includes logic for retrieving the product profile of a product purchased by a user and updating the user's taste profile based on the product profile. The network computer further selects a set of recipes based on the user's taste profile, identifies recipes in the set including the purchased product as one of the ingredients, and transmits at least one of the identified recipes to the user.

In yet another embodiment of the invention, a system for recommending recipes and shopping lists includes a customer database, a recipe database, and a network computer coupled to the customer database and the recipe database. The network computer includes logic for creating a user's taste profile and storing the user's taste profile in an associated customer record in the customer database. The network computer further selects a plurality of recipes from the recipe database for recommendation based on the user's taste profile, and receives a user selection of a recommended recipe. The network computer then creates a shopping list including ingredients associated with the selected recipe, and updates the user's taste profile based on the recipe profile for the selected recipe.

It should be appreciated, therefore, that the present system provides ease and convenience for parents in charge of cooking for the family. The recommended recipes help provide variety to the family's meals while catering to the tastes of the various family members. In addition, the automatic creation of shopping lists releases the parent from spending time in doing so manually, and helps ensure that the necessary ingredients will be purchased and available when the recipe is to prepared.

BRIEF DESCRIPTION OF THE DRAWINGS

These and other features, aspects and advantages of the present invention will be more fully understood when considered with respect to the following detailed description, appended claims and accompanying drawings wherein:

DETAILED DESCRIPTION OF THE INVENTION

Figure 1:
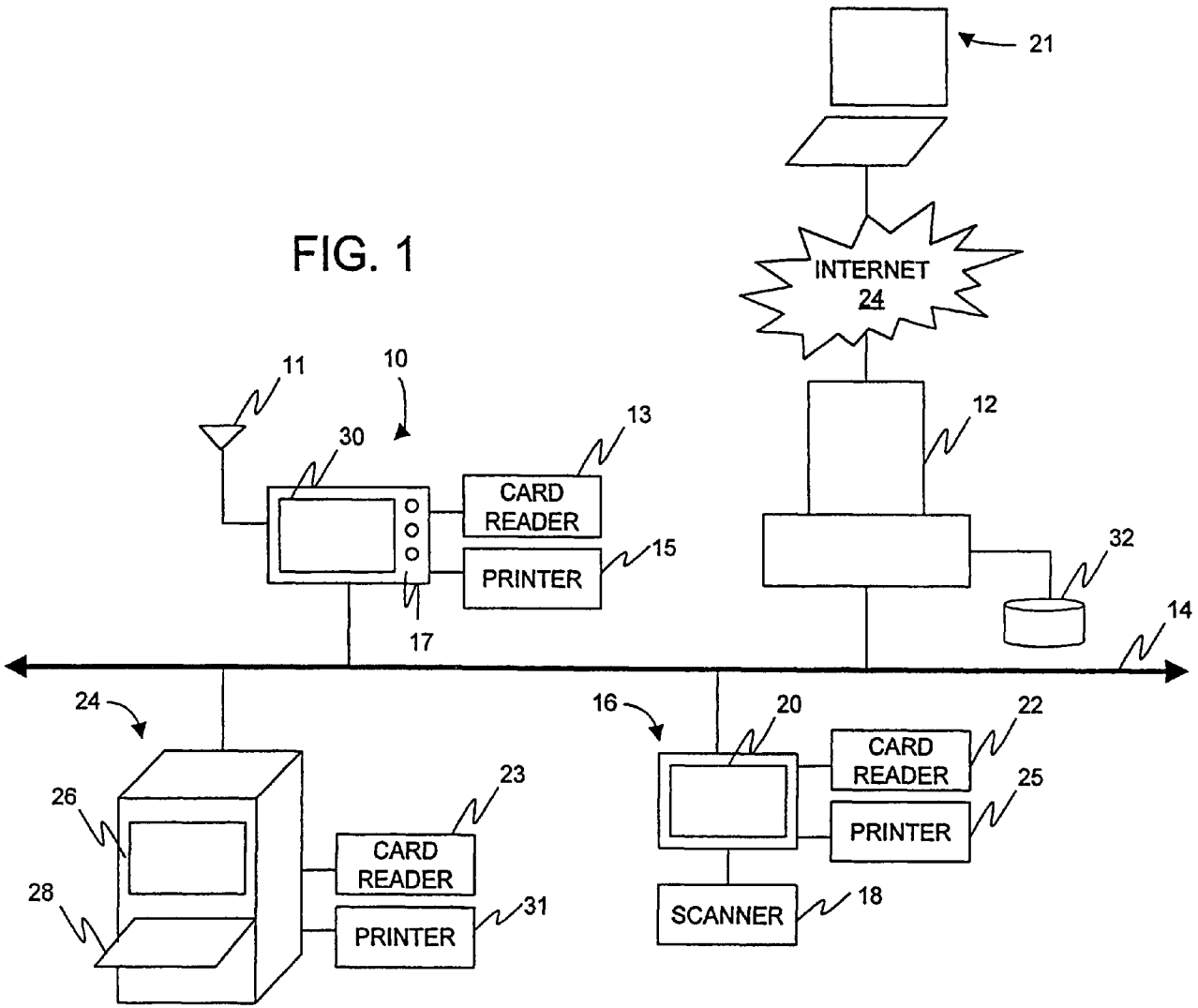
FIG. 1 is a block diagram of a system configuration for recommending recipes and shopping lists according to one embodiment of the invention.

FIG. 1 is a block diagram of a system configuration for recommending recipes and shopping lists according to one embodiment of the invention. The system configuration is preferably employed in a retail facility such as, for example, a supermarket.

The system preferably includes a multiplicity of customer terminals (generally referenced at 10) which may be mounted along merchandise display shelves or otherwise suitably affixed to shopping carts used within the retail facility. Each customer terminal 10 may be electronically connected to a network server or store platform computer system (herein referred to as the network server) 12 via a network signal bus 14, configured to support and operate as a local area network. The local area network may be any one of a number of conventional network configurations known in the art, whether serial or parallel, such as, for example, token-passing architectures, RS-232-type serial daisy-chains, serial arbitrated loops, and the like.

Each customer terminal 10 may also include a receiver/transmitter 11 for wirelessly communicating with the server 12 via radio frequency (RF) signals. Each customer terminal preferably further includes a display screen 30 and some form of an input device 17, such as a keyboard, keypad, or the like. Pressure sensitive (touch screen) technology may also be incorporated into the display screen 30 so that the user may interact with the customer terminal 10 by merely touching certain portions of the screen.

The customer terminal 10 preferably further includes a card reader 13 for interacting with a store loyalty club card, customer ID card, or some other membership card or smart card conventional in the art (collectively referred to as a customer card). The customer card may be a contact-type IC card, a magnetic stripe card, barcode card, barcode tag, wireless tag, wireless card, or the like, storing at least a customer identification (ID) number. The card reader preferably functions to receive the customer ID from the customer card and transmit it through the network signal bus 14 to the network server 12 for verification and retrieval of the customer's information. The customer terminal 10 may further include a printer 15 for printing recipes, shopping lists, coupons, promotional information, and the like.

In addition to the customer terminals 10, the network signal bus 14 preferably also hosts and supports bi-directional communication between the network server 12 and point-of-sale (POS) terminals (generally referenced at 16), such as would normally be provided at customer check-out lanes. The POS terminals 16 are preferably computer-based, microprocessor operated sales terminals for sensing, identifying, and registering items being purchased upon scanning an item's barcode with a barcode scanner 18. As each item is scanned, the item's universal product code (UPC) and/or stock keeping unit (SKU) number, item description, and item price are preferably displayed on an integral display screen 20 for easy and convenient viewing and verification by the scanning clerk and the customer. A keyboard or keypad (neither of which are shown) is also typically provided in order that the scanning clerk may manually enter the SKU number of an item which is unable to have its barcode read for any reason.

The POS terminals 16 may each include a printer 25 for printing out receipts, recipes and other information received from the network server 12. The POS terminals 16 may each further include a card reader 22 which may be similar to the card reader 13 of the customer terminal 10 for retrieving a customer ID.

Provision is preferably made in the exemplary system configuration of FIG. 1, for coupling additional terminal types to the network signal bus 14 for interfacing with the store network server 12. These additional terminal types may include self checkout terminals, store PC-based work stations, kiosk terminals, and the like. FIG. 1 illustrates one of these additional terminal types as a kiosk terminal 24 that preferably includes a display screen 26 and an input device 28. The input device may includes a keyboard, keypad, touch screen, or the like. The kiosk terminal 24 preferably further includes a card reader 23 for interacting with a customer card. The card reader 23 coupled to the kiosk terminal 24 may be similar to the card reader 13 coupled to the customer terminal 10. The kiosk terminal 24 also preferably includes a printer 31 for printing information for a customer, such as recipes, shopping lists, coupons, promotional information, and the like.

In accordance to the system illustrated in FIG. 1, the network server 12 preferably includes logic for building a taste profile for a user based on past purchase information, recommending recipes based on the taste profile, and creating a shopping list based on one or more of the recommended recipes. The network server 12 further includes a mass storage device 32, such as a hard disk drive, or drive array, that hosts a number of purpose-built databases. Such databases preferably include product, recipe, and customer databases. The network server 12 further communicates with a user's personal computer 21 via a public wide area network, such as, for example, the Internet 24. The personal computer 21 may alternatively be replaced with a television, personal digital assistant, home appliance, or any other device equipped for communicating with the network server 12 over the Internet 24.

In general terms, a customer selects items for purchase at the retail facility and proceeds to the POS 16 for checkout. The customer preferably presents his or her customer card during the checkout process. The card reader 22 coupled to the POS 16 reads the customer card and retrieves customer information from the card. Preferably, at least a customer identifier is stored in the card for use by the network server 12 to retrieve the customer's purchase history data. As each item is scanned during the checkout process, the network server 12 preferably updates the customer's purchase history data to reflect the purchased item.

The network server 12 preferably uses the customer's purchase history data to build or update a taste profile for the customer. The taste profile is preferably stored in the customer database. The network server uses the taste profile to select and recommend recipes aimed to be to the user's liking that may be prepared using the ingredients just purchased. The recipes may be provided to the user prior to his or her leaving the retail establishment via the customer terminal 10, POS terminal 16, and/or kiosk terminal 24. Preferably, the recipes are printed using the printer 15, 31, or 25, and given to the user to take home. Alternatively, the recipes are e-mailed to the user's PC 21 for later retrieval once the user arrives home.

The network server 12 further preferably creates a meal plan for the user based on the user's taste profile, and provides the meal plan to the user over the Internet 24. Preferably, the meal plan is e-mailed to the user's PC 21 on a periodic basis, such as, for example, on a weekly basis. The meal plan may also be accessible to the user via the customer terminal 10, POS terminal 16, or kiosk terminal 24, and printed using printer 15, 25, or 31. The meal plan preferably includes recipes for meals to be prepared for the week.

The network server 12 further provides in conjunction with the meal plan a shopping list of ingredients needed to prepare the recipes included in the meal plan. The shopping list may be e-mailed to the user's PC 21 over the Internet 24 prior to a next scheduled shopping trip, or retrieved by the user via the customer terminal 10 or kiosk terminal 24 at the time of shopping. The shopping list may further be accompanied by promotion information, coupons, and the like, which may be used in the upcoming shopping trip.

Figure 2:
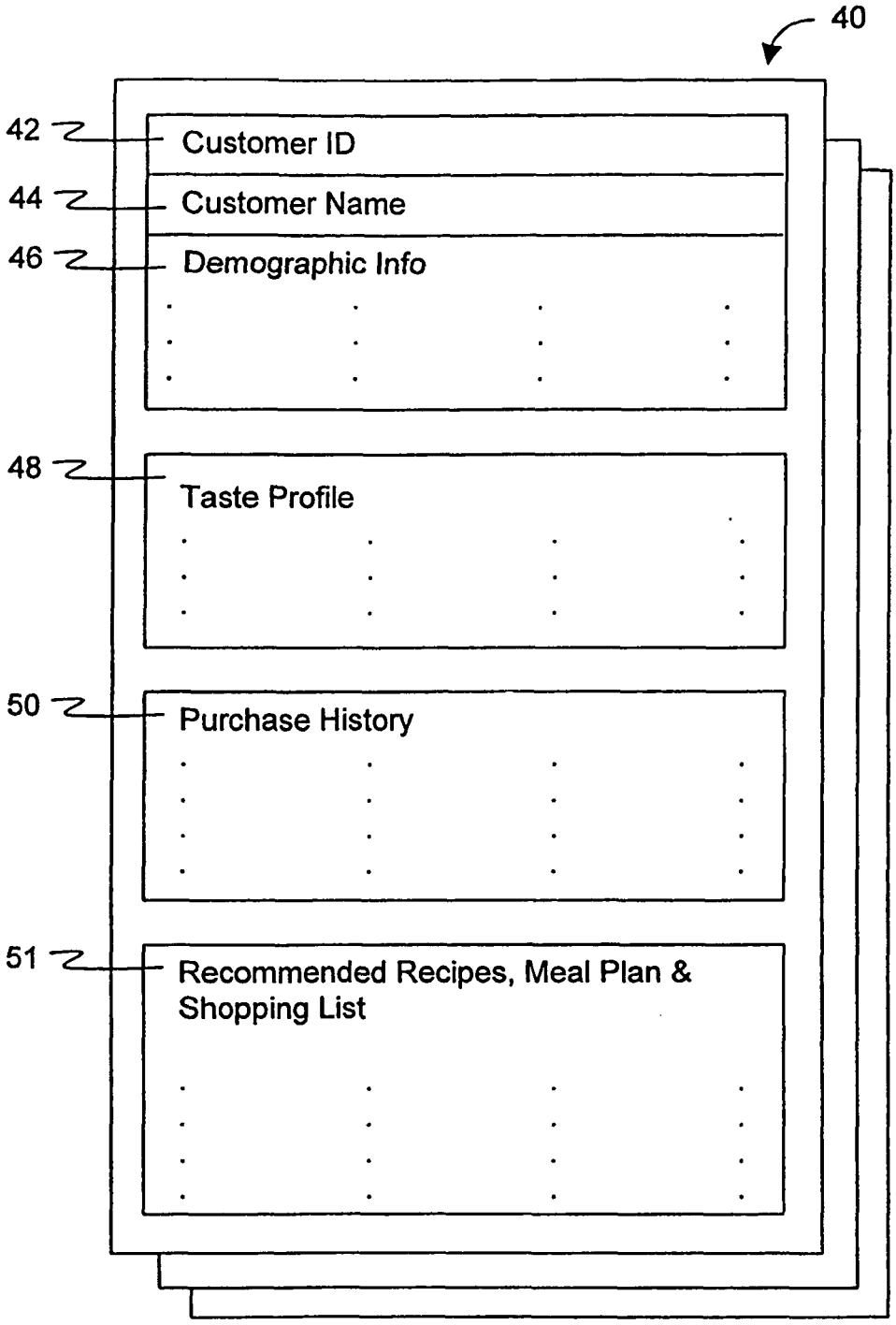
FIG. 2 is a schematic block diagram of an exemplary customer database according to one embodiment of the invention.

FIG. 2 is a schematic block diagram of the information storage layout of an exemplary customer database in the mass storage device 32 according to one embodiment of the invention. The customer database preferably includes a series of customer specific records (identified generally at 40) each of which is headed and identified by a customer ID 42 corresponding to the customer ID on a customer card. Following the customer ID 42, each customer record further includes a customer name 44 and the customer's demographic information 46. The demographic information 46 may include the customer's address, telephone number, date-of-birth, information relating to the customer's family status, the number of children, and the like.

Each customer record 40 preferably includes a taste profile area 48 preferably depicting the customer's food taste based on the purchases made at the retail establishment. The taste profile area 48 preferably includes one or more taste vectors where each field of the vector is associated with a particular food characteristic, as is described in further detail in U.S. Ser. No. 09/792,343. The food characteristic is preferably a chemical component contained in food, a food category, or the like. The value contained in each vector field preferably reflects the user's preference for the corresponding food characteristic. The taste profile area 48 is preferably updated at the end of each shopping trip where a food-related purchase has been made.

Each customer record also includes a purchase history area 50 storing a sequential list of purchase histories. Each purchase history entry is preferably a sequence of lists, with each list including, for example, a date of purchase, a universal product code (UPC) and/or stock keeping unit (SKU) number, an item description, a quantity, an item price, and the like.

In addition to the above, each customer record further includes the recipes, meal plan, and shopping list 51 recommended for a most recent shopping trip. The meal plan may be organized based on the days of the week, particular meal categories (e.g. breakfast, lunch, or dinner), and the like.

Each customer record 40 may further include certain additional information areas (not shown) which may be used to record and maintain information relating to, for example, incentive or loyalty point awards, and store information relating to any coupon codes or special classification metrics (gold card, superclub member, and the like) that might have been awarded to a customer. It should be evident to a person skilled in the art that the additional fields may further maintain other different types of information relating to a customer's transactional preferences and information that may be of use to a retail store in analyzing customer preferences, the effects of advertising, and any other information that may be needed to provide specialized, personalized service to various types of particular customers.

In an alternative embodiment, all or a portion of the information stored in the customer record 40 is instead maintained in the customer card. In this scenario, the customer card is preferably a smart cart configured with a memory that is large enough to store the desired information.

Figure 3:
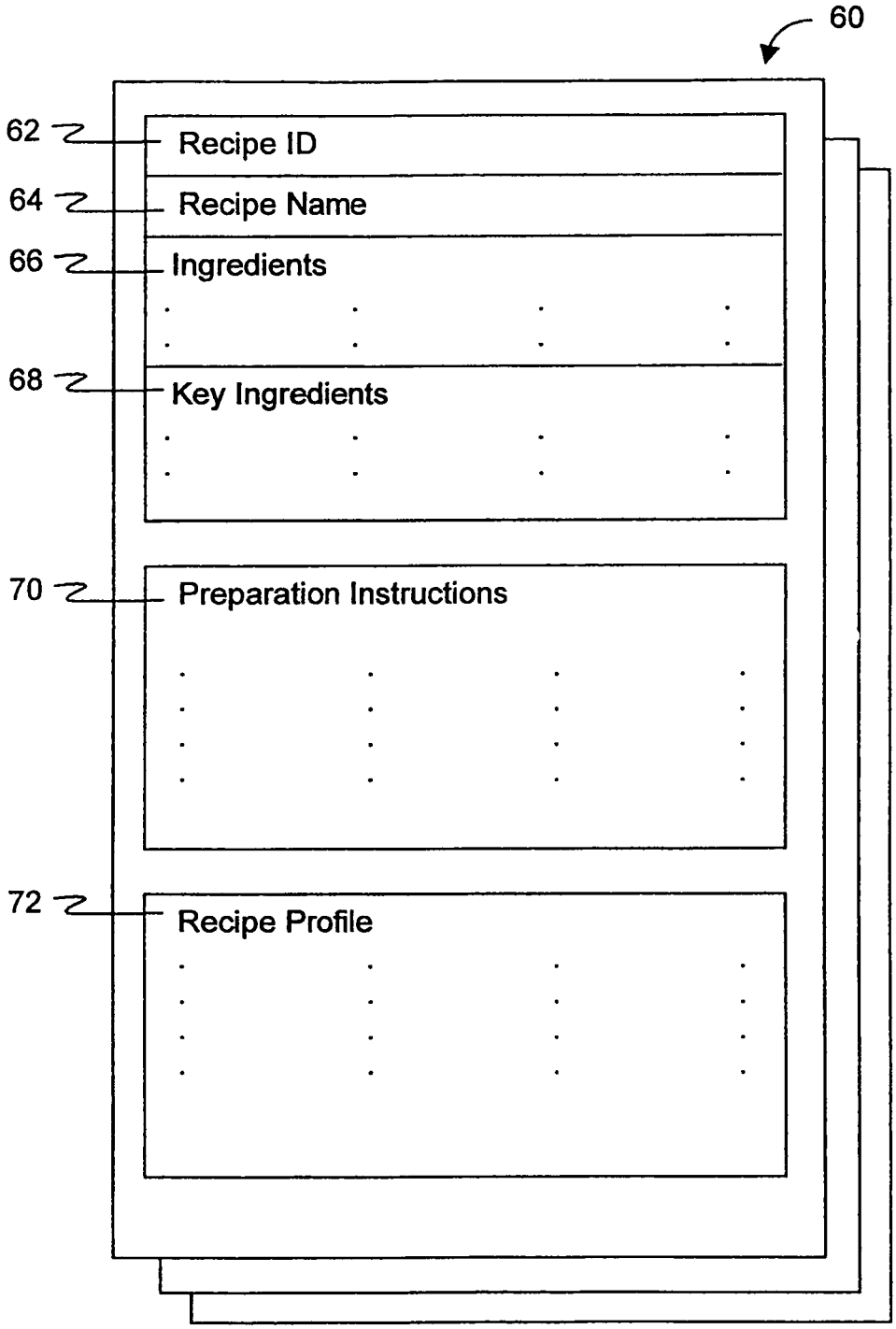
FIG. 3 is a schematic block diagram of an exemplary recipe database according to one embodiment of the invention.

FIG. 3 is a schematic block diagram of the information storage layout of an exemplary recipe database in the mass storage device 32 according to one embodiment of the invention. The recipe database preferably includes a series of recipe records (identified generally at 60) each of which is headed and identified by a recipe ID 62 and a recipe name 64. Each recipe record further includes a list of ingredients in an ingredients area 66 needed for preparing the recipe. The ingredients area 66 preferably stores a key ingredients flag for each ingredient that is considered key in preparing the recipe. A preparation instructions area 70 further provides guidance in preparing the recipe.

In addition to the above, each recipe record further includes a recipe profile area 72 providing characterizations of the recipe. The recipe profile area 72 preferably includes a recipe profile vector where each field of the vector is associated with a particular food characteristic. As in the user preference vector, the food characteristic is preferably a chemical component contained in food, a food category, or the like. The value contained in each vector field preferably reflects the amount of the corresponding food characteristic contained in the recipe.

Figure 4:
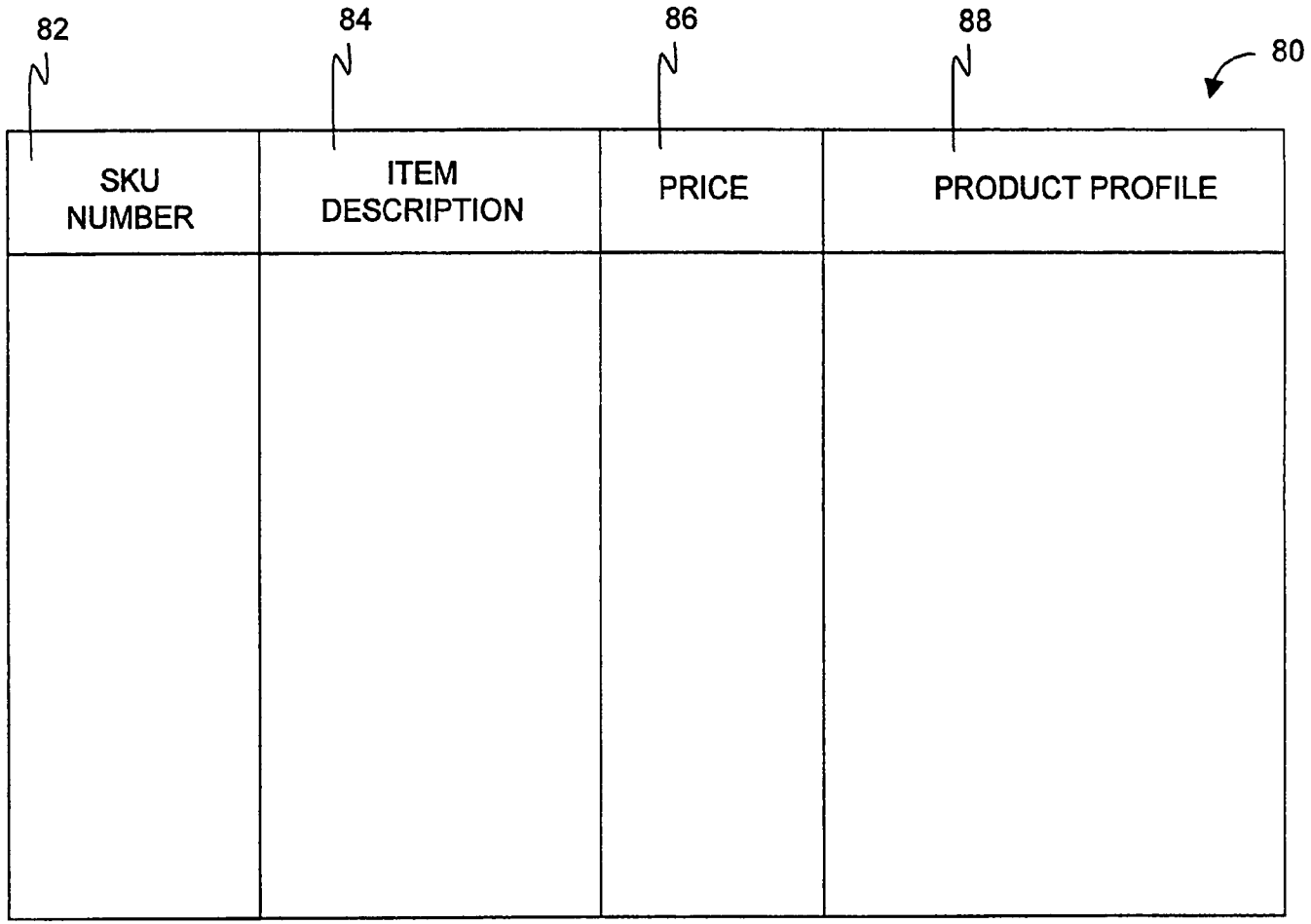
FIG. 4 is a schematic block diagram of a product database according to one embodiment of the invention.

FIG. 4 is a schematic block diagram of the information storage layout of a product database according to one embodiment of the invention. The product database preferably includes a product information table 80 which includes a set of merchandise specific information. The merchandise specific information may be arranged in a variety of ways, but is most advantageously configured as sequential entries, with each entry specific to a particular piece of merchandise. A particular merchandise entry preferably includes a product's SKU number 82, which is identified to a particular product's Universal Product Code (UPC) by a suitable conversion routine. A particular merchandise entry further includes an item description field 84, typically implemented as a text string that gives the brand or trade name of the associated product, a generic description of the product, and/or an identifying weights and measures metric, such as, for example, PHILADELPHIA® cream cheese, 8 oz. A price field 86 also included in the product table 80 provides pricing information for the product.

In addition to the SKU number 82, item description field 84, and price 86, the product table 80 preferably includes a product profile field 88 providing characterizations of food items sold in the retail facility. The product profile field preferably includes a product profile vector where each field of the vector is associated with a particular food characteristic. Similar to the user preference and recipe vectors, the food characteristic is preferably a chemical component contained in food, a food category, or the like. The value contained in each vector field preferably reflects the amount of the corresponding food characteristic present in the product.

According to one embodiment of the invention, each chemical component or combination of chemical components creates a particular type of taste (e.g. saltiness, bitterness, etc.). A value is assigned to the various chemical components based on the user's preference to such chemicals. Weights are assigned to the chemical compositions based on the contribution of each chemical composition to a dish's taste or attribute. According to one embodiment of the invention, the chemical compositions may include copper, manganese, selenium, thiamine, niacin, tryptophan, threonine, isoleucine, leucine, lysine, methionine, cystine, phenylalanine, tyrosine, valine, arginine, histidine, alanine, aspartic acid, glutamic acid, glysine, proline, and serine.

Figure 5:
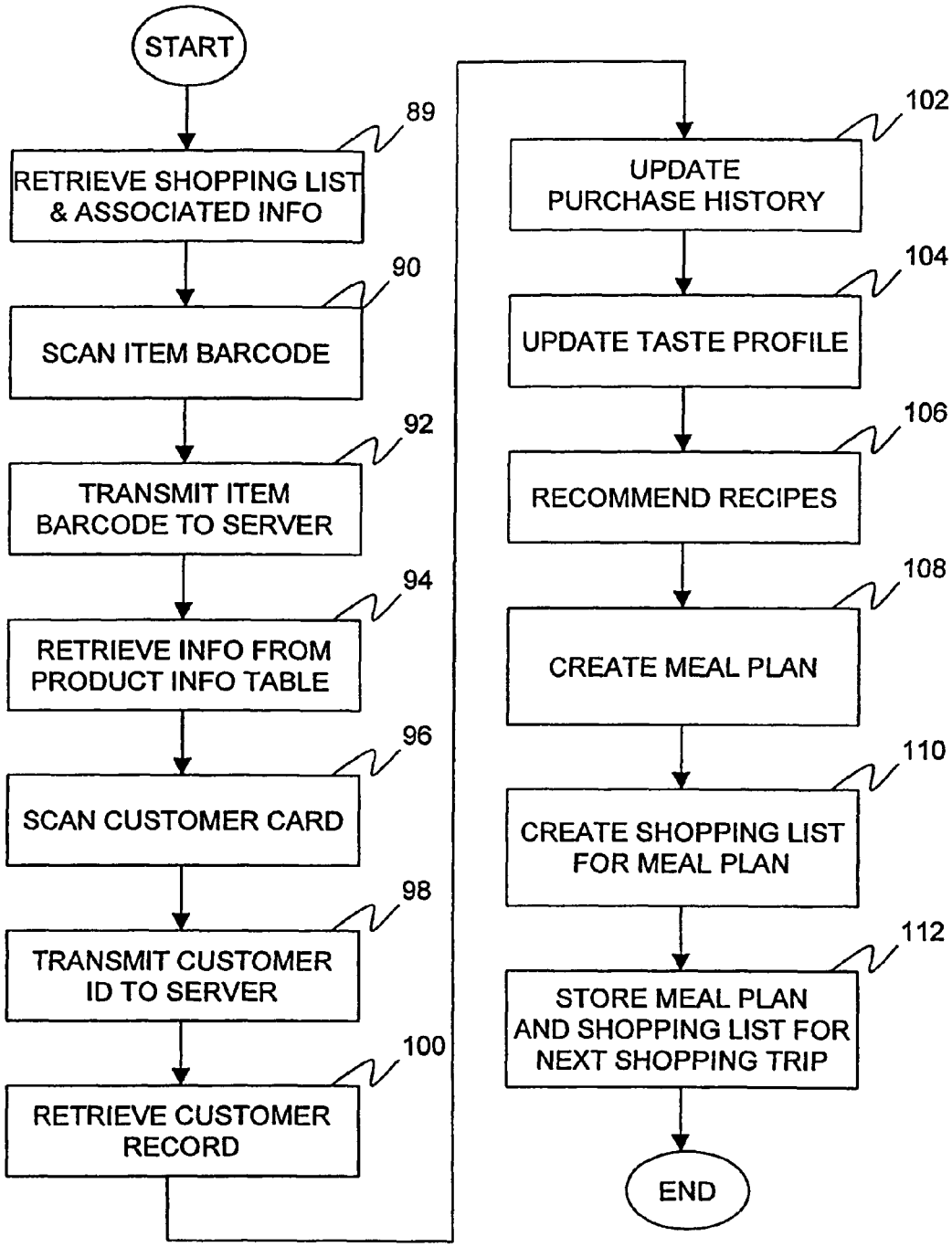
FIG. 5 is a flow diagram of a process for recommending recipes and shopping lists according to one embodiment of the invention.

FIG. 5 is a flow diagram of a process for recommending recipes and shopping lists according to one embodiment of the invention. The process starts, and in step 89, a returning customer uses his or her customer card at the customer terminal 10 or kiosk terminal 24 to retrieve a shopping list created for the user along with any coupons and promotional materials offered through the retailer. The user may also retrieve a meal plan recommended to the user from which the shopping list was created. Alternatively, the shopping list, meal plan, coupons, and/or promotional materials may be e-mailed to the user's PC 21 prior to the scheduled shopping trip.

The user uses the shopping list to select items for purchase, and proceeds to the POS terminal 16 once all the items have been selected and the user is ready for checkout. In step 90, a checkout clerk at the POS terminal 16 preferably uses the scanner 18 attached to the POS terminal 16 to scan a barcode on each selected item. As each item is scanned, the POS terminal 16, in step 92, transmits the scanned barcode to the network server 12 via the network signal bus 14. In step 94, the network server 12 invokes a search and retrieval routine for searching the product information table 80 for a matching SKU number 82 and retrieving the associated item description 84, price 86, and product profile 88. The item description and price are preferably transmitted back to the POS terminal 16 and displayed on the display screen 20 for verification.

In step 96 the card reader 22 coupled to the POS terminal 16 reads the customer card and retrieves from the card at least a customer ID. The reading of the customer card may be accomplished before, during, or after the scanning of the items to be purchased. In step 98, the POS terminal 16 transmits the customer ID to the network server 12 via the network signal bus 14. The network server receives the customer ID, and in step 100, proceeds to retrieve a corresponding customer record for updating the information contained therein. For instance, in step 102, the network server 12 updates the purchase history area 50 to add the items purchased in the current shopping trip. The network server 12 preferably writes to the purchase history area a date of the purchase and each purchased item's UPC and/or SKU number, description, quantity, price, and the like.

In step 104, the network server 14 updates the taste profile area 48 based on the recent purchase data. In this regard, the network server 12 retrieves the user's taste vector and the product vector of each recently purchased item. According to one embodiment of the invention, the value in each field of the user's taste vector associated with a particular food characteristic is modified with an average of the current value and the value in the product vector for the corresponding characteristic. According to an alternative embodiment of the invention, the calculated average is further modified based on purchase history information, such as, for instance, the timing between purchases, quantity purchased, and the like. For instance, if the time between purchases for a particular item is longer than a predetermined time period, an assumption may be made that the item is not consumed very often and thus, not particularly the user's favorite. The item may accordingly be given less weight in modifying the user's taste vector.

In an alternative embodiment, the user's purchase of key ingredients contained in a previously recommended recipe or meal plan is used as an indication that the user likes the dishes that were recommended. In this scenario, the network server 12 updates the user's taste vector based on the recipe profile associated with the recommended recipe containing the purchased key ingredient.

In step 106, the network server 12 recommends recipes to the user for meals that may be created using the recently purchased items. Preferably, the network server 12 searches the recipe database for recipes whose key ingredients are among the currently purchased items. Among such identified recipes, the network server 12 further recommends a predetermined number of recipes that are catered to be to the user's liking. According to one embodiment of the invention, vector distance calculations are performed between recipe vectors of the identified recipes in the recipe profile area 72 and the user's taste vector in the taste profile area 48, and a recipe with the smallest vector distance is selected for recommendation as is discussed in further detail in U.S. Ser. No. 09/792,343.

According to an alternative embodiment of the invention, the selection of recipes is not only based on vector distance calculations, but also based on particular selection rules. One exemplary selection rule may require variety in the user's meals. Thus, recipes that have not been recommended for a predetermined period of time may be selected over recipes that have been recently recommended. Another exemplary selection rule may be based on holidays, events, seasons, and the like. Thus, particular foods may be recommended during Christmas time that may not be recommended during other times. Also, recipes with ingredients that are in season may be recommended over recipes whose ingredients are not in season. Other selection rules may be based on cooking situations, such as, for example, indoor cooking, outdoor cooking, necessary cooking time, and the like.

According to another embodiment of the invention, preference may be given to recipes that include particular ingredients. For instance, if two recipes have the same vector distance, a recipe including an ingredient on sale or for which a coupon is available may be preferred for recommendation over the other recipe.

The recommended recipes may be printed via the POS terminal 16, customer terminal 10, or kiosk terminal 24, and provided to the user prior to leaving the retail establishment. Alternatively, the recipes may be e-mailed to the user's PC 21 for later retrieval when the user gets home. The recipes are also saved in the customer record and used for updating the user's taste profile.

In step 108, the network server 12 creates a meal plan for the user for an upcoming time period, such as, for instance, the upcoming week. In creating the meal plan, the network server 12 selects appetizers, entrees, side dishes, soups, salads, wines, and/or desserts for the various meals of a day based on information in the user's taste profile area 48. Preferably, one or more selection rules are invoked for selecting the appropriate dishes. One particular selection rule may limit the side dishes based on the type of entree to be recommended. For instance, if the main entree is Chinese food, the selection rule may limit the side dish to only other Asian side dishes. In addition, the network server 12 may also create the meal plan based on ingredients that are on sale or for which a coupon is available.

In step 110, the network server 12 creates a shopping list based on the meal plan. According to one embodiment of the invention, whether a particular ingredient is included in the shopping list may depend on the user's past purchase history. For instance, if a recommended recipe requires a teaspoon of salt, the network server 12 may not include salt into the shopping list if it has been recently purchased. In an alternative embodiment, all ingredients in the recipe are included into the shopping list, but the user is given the option to remove a particular ingredient if it need not be purchased.

In step 112, the network server 12 stores the meal plan and shopping list in the user's customer record, and retrieves the same for providing to the user at a predetermined time prior to a next scheduled shopping trip, such as for example, the beginning of the week. According to one embodiment of the invention, the meal plan and shopping list are e-mailed to the user's PC 21 at such predetermined time. Alternatively, the user may obtain the meal plan and shopping list at the retail establishment via the kiosk or user terminal 24, 10 prior to embarking in his or her shopping expedition.

In an alternative embodiment of the invention, the user embarks in a virtual shopping trip and does not physically visit a retail establishment. According to this embodiment, the user utilizes his or her PC 21 to access a website provided by the network server 12. The server preferably recommends several recipes to the user based on the user's taste profile. The user preferably selects the recipes that he or she likes, and requests for a shopping list. The user may review and accept the shopping list, causing the selected items to be inserted into an electronic shopping cart for purchase.

The selected recipes are preferably used by the network server 12 to update the user's taste profile. In doing so, certain recipes may be given more or less weight based on a percent of the time a particular recipe is selected once it has been recommended. For instance, if a recipe is selected only half of the time, it may not be one of the user's favorites. Accordingly only half of the weight may be given to the recipe.

Although this invention has been described in certain specific embodiments, those skilled in the art will have no difficulty devising variations which in no way depart from the scope and spirit of the present invention. It is therefore to be understood that this invention may be practiced otherwise than is specifically described. Thus, the present embodiments of the invention should be considered in all respects as illustrative and not restrictive, the scope of the invention to be indicated by the appended claims and their equivalents rather than the foregoing description.

The invention claimed is:

1. An electronic shopping system for use in a retail facility for updating user food tastes and recommending recipes based on the updated user food tastes, the electronic shopping system comprising:

a database storing an objective description of a user's food taste, the objective description being represented via a taste vector having N fields associated with N chemical components found in food, each of the N fields storing a value representing a current preference for the corresponding chemical component, wherein N>0;

a terminal configured to receive identification information of at least one of a plurality of food items selected for purchase by a user; and a network computer coupled to the terminal, the network computer being configured to:

retrieve the taste vector representing the user's food taste from the database;

update the taste vector representing the user's food taste based on the at least one of the plurality of food items selected for purchase, wherein the updating includes modifying one or more of the values stored in the taste vector representing the current preference for the one or more of the N chemical components based on the at least one of the plurality of food items selected for purchase, and storing the one or more of the modified values in the taste vector;

select a set of recipes based on the updated taste vector; and provide at least one of the identified recipes to the user.

2. The system of claim 1, wherein the selection of the set of recipes is further based on a predetermined selection rule.

3. The system of claim 1, wherein the at least one of the identified recipes is provided to the user via the terminal.

4. The system of claim 1, wherein the at least one of the identified recipes is provided to the user via electronic mail.

5. The system of claim 1 further comprising a second terminal coupled to the network computer, wherein the at least one of the identified recipes is provided to the user via a second terminal.

6. The system of claim 5, wherein the second terminal is a hand-held device.

7. The system of claim 1, wherein the network computer is configured to create a meal plan based on the updated taste vector and transmit the meal plan to the user at a predetermined time.

8. The system of claim 7, wherein the network computer is configured to create a shopping list based on the meal plan and transmit the shopping list at the predetermined time.

9. The system of claim 1, wherein each of the recipes in the selected set is represented via a recipe vector, wherein the recipe vector includes N second numerical values quantifying the N chemical components found in food, and the selecting of the set of recipes includes a vector distance calculation between each of the recipe vectors and the taste vector representing the taste profile for the user.

10. The system of claim 1, wherein a weight is assigned to at least one of the N chemical components, wherein the weight that is assigned is based on the particular chemical component's contribution to taste.

11. The system of claim 1, wherein at least one of the N chemical components is copper.

12. The system of claim 1, wherein at least one of the N chemical components is manganese.

13. The system of claim 1, wherein at least one of the N chemical components is selenium.

14. The system of claim 1, wherein at least one of the N chemical components is thiamine.

15. The system of claim 1, wherein at least one of the N chemical components is niacin.

16. The system of claim 1, wherein at least one of the N chemical components is tryptophan.

17. The system of claim 1, wherein at least one of the N chemical components is one of threonine, isoleucine, leucine, lysine, methionine, cystine, phenylalanine, tyrosine, valine, arginine, histidine, and alanine.

18. The system of claim 1, wherein at least one of the N chemical components is aspartic acid.

19. The system of claim 1, wherein at least one of the N chemical components is glutamic acid.

20. The system of claim 1, wherein at least one of the N chemical components is one of glysine, proline, and serine.

* * * * *